United States Patent [19]

Kandatsu

[11] Patent Number: 4,945,326

[45] Date of Patent: Jul. 31, 1990

[54] CIRCUIT BREAKER

[75] Inventor: Kiyoshi Kandatsu, Kanagawa, Japan

[73] Assignee: Fuji Electric Co., Ltd., Kanagawa, Japan

[21] Appl. No.: 329,706

[22] Filed: Mar. 28, 1989

[30] Foreign Application Priority Data

Apr. 18, 1988 [JP] Japan ..... 63-94862

[51] Int. Cl.[5] ..... H01H 75/00

[52] U.S. Cl. ..... 335/16; 335/147; 335/195

[58] Field of Search ..... 335/16, 147, 195; 200/147 R

[56] References Cited

U.S. PATENT DOCUMENTS 3,562,680 2/1971 Ryojiozaki et al. ..... 335/16
3,815,059 6/1974 Spoelman ..... 335/16
3,953,811 4/1976 Mostosi ..... 335/16
4,417,223 11/1983 Bancalari ..... 335/195
4,458,224 7/1984 Kralik et al. ..... 335/16

*Primary Examiner*—Leo P. Picard
*Assistant Examiner*—Lincoln Donovan
*Attorney, Agent, or Firm*—Finnegan, Henderson, Farabow, Garrett, and Dunner

[57] ABSTRACT

A compact, high capacity circuit breaker includes two breaking portions mounted in a single casing, with movable contacts for each portion disposed in series with one another and supported by a common switching shaft. Both portions of the breaker are tripped by either an overcurrent condition or manual operation, and the positioning of the common switching shaft maintains both breaking portions in the open state.

8 Claims, 3 Drawing Sheets

CIRCUIT BREAKER

BACKGROUND OF THE INVENTION

1. Field of the Invention

The present invention relates to a circuit breaker, and more particularly to a circuit breaker with a high breaking capacity provided with two breaking portions.

2. Description of the Related Art

An example of a circuit breaker with a high breaking capacity, known in the prior art is illustrated in FIG. 5. In FIG. 5, the circuit breaker comprises a first breaking portion 50, housed within a space defined by an insulating casing 41 and an insulating cover 42, which are positioned in an upper side of the circuit breaker and arranged to be separable upward and downward respectively. The first breaking portion 50 includes a first fixed contact 43, a first movable contact 44 disposed to make contact with and separate from the first fixed contact 43, an overcurrent tripping device 47 connected in series with the first movable contact 44 through a flexible conductor 45 and having a tripping crossbar 46, and a switching mechanism 48 coupled with the first movable contact 44 and engaged with a pawl 46*a* of the tripping crossbar 46. The circuit breaker further comprises a second breaking portion 60, housed within an insulating casing 51 which is attached to the back wall of the insulating casing 41. The second breaking portion 60 includes a second fixed contact 53 electrically connected in series with the first fixed contact 43 through a flexible conductor 52, and a second movable contact 55 having a closing spring 54 and disposed in opposition to the second fixed contact 53 to make contact with and separate from the second fixed contact 54.

If a large current such as a short-circuit current flows in the thus arranged current path, the second breaking portion 60 is opened first by an electromagnetic force sufficient to overcome the closing spring 54, and the first breaking portion 50 is then opened by a tripping operation of the overcurrent tripping device 47.

The conventional circuit breaker described above has several disadvantages. First, due to the independent housing of the first and second breaking portions 50 and 60 within the insulating casings 41 and 51 respectively, the circuit breaker is physically large and the current path between the two portions is long. Further, when the current flowing in the second breaking portion 60 is limited in a final breaking step, the electromagnetic repulsion force is reduced and can be overcome by a spring force of the closing spring 54, thereby allowing the second breaking portion 60 to close again. Therefore, only an opening of the first breaking portion 50 can be relied on to achieve the desired breaking of the circuit. Consequently, it has been difficult to manufacture a circuit breaker having a high breaking capacity for use in a high-voltage environment.

SUMMARY OF THE INVENTION

It is an object of the present invention to solve the foregoing conventional problems, and to provide a two-point-breaking circuit breaker having a high breaking capacity which is small in size and in which re-closing of the second breaking portion does not occur in the final breaking step.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

In order to attain the foregoing objects, according to the present invention, the circuit breaker comprises: a casing enclosing a first breaking portion including a first fixed contact and a first movable contact supported by a switching shaft so as to be able to make contact with and separate from the first fixed contact and arranged so as to be separated from the first fixed contact by a tripping operation of an overcurrent tripping device through a switching mechanism; and a second breaking portion also enclosed in the casing, including a second movable contact connected in series with the first movable contact of the first breaking portion, supported by the switching shaft and provided with a contact spring, and a second fixed contact disposed in opposition to the second movable contact so as to be able to contact with and separate from the second movable contact and arranged so that currents flowing respectively in the second movable and fixed contacts are made opposite in direction to each other.

In the circuit breaker according to the present invention, since the second movable contact of the second breaking portion is arranged so as to be supported by the switching shaft which is driven by the switching mechanism of the first breaking portion and on which the first movable contact is supported, the current path can be made short, thereby making the circuit breaker small in size. Moreover, since the second movable contact can be kept in an opened state in the same manner as the first movable contact in spite of a limitation of current in the final step of breaking, a high breaking capacity is guaranteed even in the case of a high voltage.

BRIEF DESCRIPTION OF THE DRAWINGS

The accompanying drawings, which are incorporated in and constitute a part of the specification, illustrate a preferred embodiment of the invention and, together with the general description given above and detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

Figure 1:
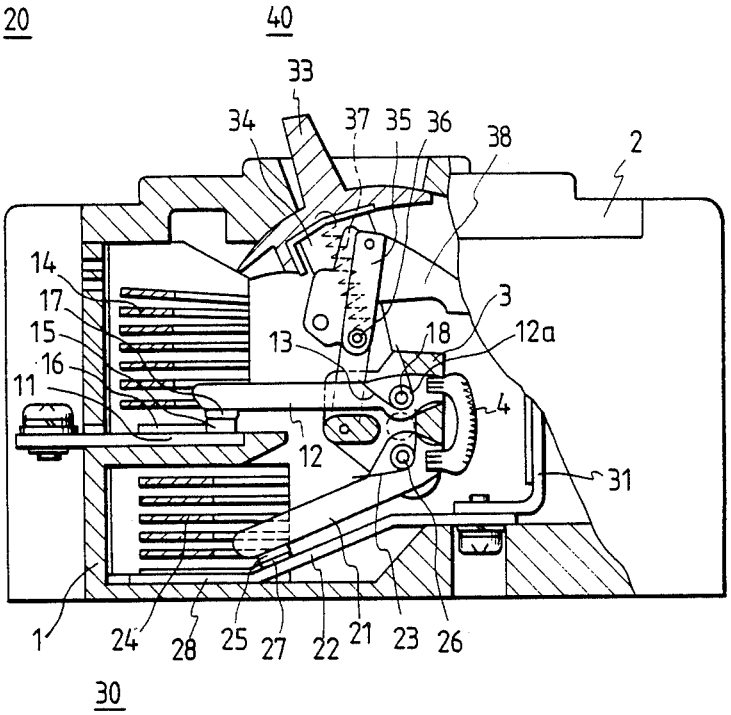
FIG. 1 is a side view partly in section of a circuit breaker illustrating the teachings of the present invention.

In accordance with the present invention, there is provided a triple-pole circuit breaker. As shown in FIG. 1, a set of first and second breaking portions, 20 and 30, respectively, an overcurrent tripping device 31, and a switching mechanism 40 are housed within a space defined by an insulating casing 1 and an insulating cover 2.

The first breaking portion 20 comprises a first fixed contact 11, a first movable contact 12, a first contact spring 13 and a first arc-extinguishing chamber 14. The first fixed contact 11 is provided with a fixed contact point 15 fixed to an end thereof, and an arcing horn 16 extended to the fixed contact point 15. The first movable contact 12 is provided with a movable contact point 17 fixed to an end thereof and opposed to the fixed contact point 15 so as to be able to contact with and separate from the fixed contact point 15, and a shaft hole 12*a* formed adjacent the other end thereof so that the first movable contact 12 is pivotally supported at this shaft hole 12*a* by an insulating switching shaft 3 through insertion of a pin 18. A first contact spring 13 coiled around the pin 18 is provided between the first movable contact 12 and the insulating switching shaft 3. The first arc-extinguishing chamber 14 is disposed to partially enclose the operating area of the first movable contact 12 on three sides.

The second breaking portion 30 is disposed in the insulating casing directly under the lower side of the first breaking portion 20, and comprises a second movable contact 21, a second fixed contact 22, a second contact spring 23 and a second arc-extinguishing chamber 24. The second movable contact 21 is provided with a movable contact point 25 fixed to an end thereof, and a shaft hole 21*a* formed in the vicinity of the other end thereof so that the second movable contact 21 is pivotally supported at this shaft hole 21*a* by the insulating switching shaft 3 through a pin 26. The second fixed contact 22 is disposed so as to be in opposition to the second movable contact 21, so that the directions of currents flowing in the second movable and fixed contacts 21 and 22 respectively oppose each other in the closed state. The second fixed contact 22 is provided with a movable contact point 27 fixed to a middle portion thereof and an arcing horn 28 extending from the portion where the movable contact point 27 is fixed. A second contact spring 23 coiled around the pin 26 is provided between the second movable contact 21 and the insulating switching shaft 3. The respective other ends of the first and second movable contacts 12 and 21 are connected with each other through a flexible conductor 4. The second arc-extinguishing chamber 24 is disposed to partially enclose the operating area of the second movable contact 21 on three sides.

Figure 2:
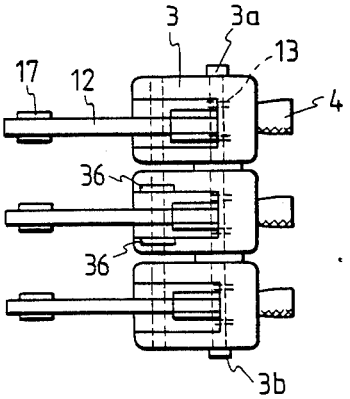
FIG. 2 is a top view illustrating the contact portion of the circuit breaker according to the present invention.

As shown in FIG. 2, opposite ends 3*a* and 3*b* of the insulating switching shaft 3 are rotatably supported by opposing inner side walls of the insulating casing 1. The switching mechanism 40 includes a switching lever 34 swingably supported by the insulating casing 1 and having an operating handle 33 inserted in its head portion, a toggle link 35 connecting the switching lever 34 to the insulating switching shaft 3, a switching spring 37 provided between a joint pin 36 of the toggle link 35 and the head of the switching lever 34, and a tripping link 38, which is engaged with a tripping pawl of the overcurrent tripping device 31, and arranged so as to be disengaged from the tripping pawl to thereby deform the toggle link 35 in response to a tripping operation.

Figure 3:
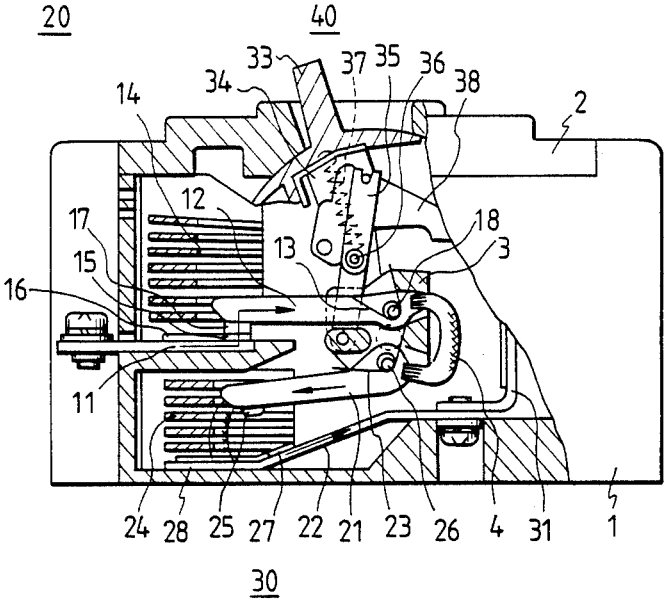
FIG. 3 is a view similar to FIG. 1 illustrating the breaking operation of the circuit breaker of the present invention.
Figure 4:
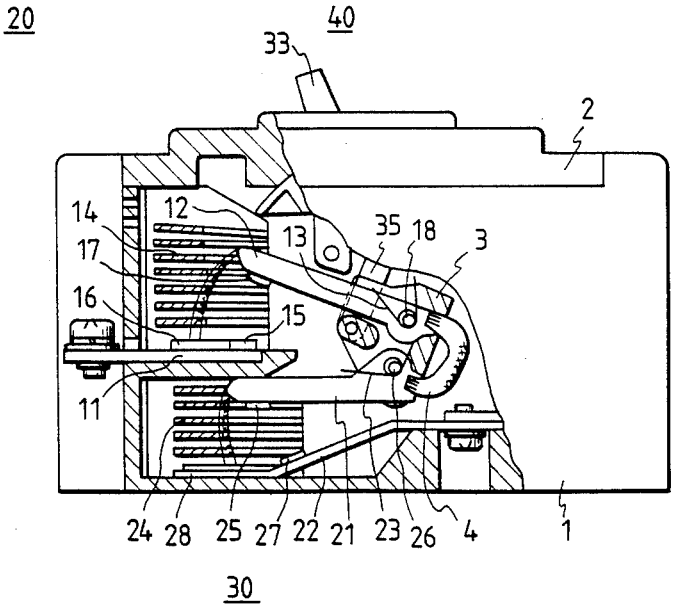
FIG. 4 is a view similar to FIG. 1 illustrating the contact position at the completion of the breaking operation of FIG. 3.
Figure 5:
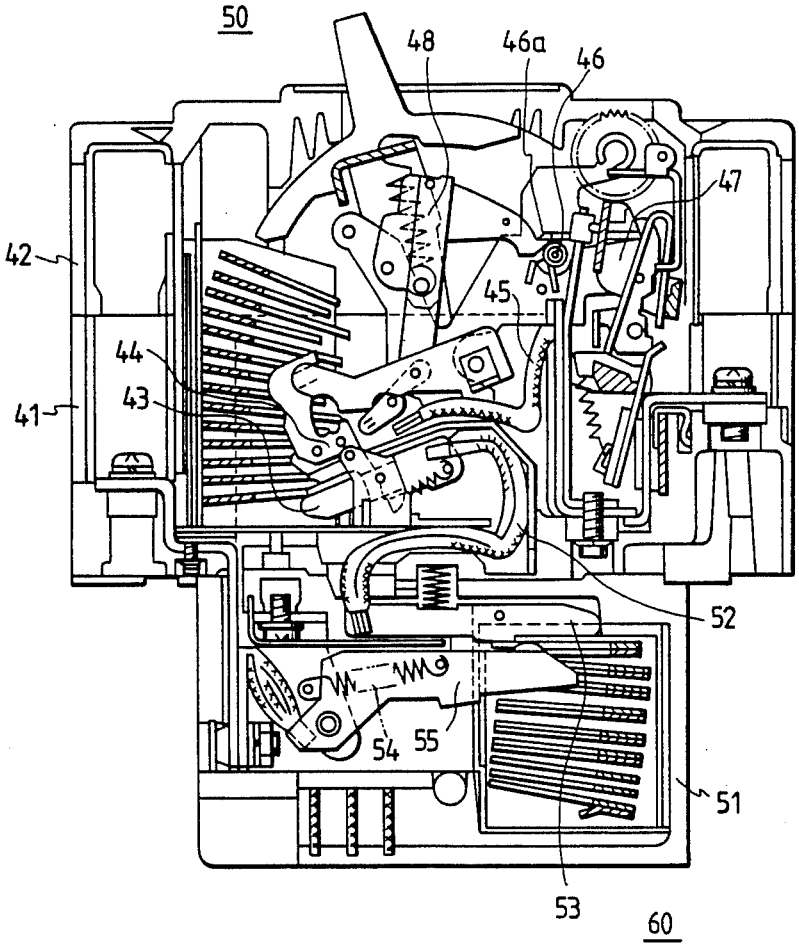
FIG. 5 PRIOR ART
FIG. 5 is a longitudinal sectional view of a conventional circuit breaker.

In the above configuration, when a short-circuit current flows in the current path comprising the first and second breaking portions 20 and 30 and the over-current tripping means 31, an electromagnetic repulsion force is generated by currents flowing in the second movable and fixed contacts 21 and 22 respectively, in directions opposite to each other as shown by the arrows in FIG. 3, so that the second movable contact 21 overcomes the contact spring 23 and starts the breaking operation prior to the opening operation of the switching mechanism 40. Next, as shown in FIG. 4, the overcurrent tripping device 31 releases the engagement of the tripping link 38. The switching mechanism 40 operates to deform the toggle link 35 so that the first and second movable contacts 12 and 21 are maintained in their fully-open positions about the axis line of the shaft ends 3*a* and 3*b* of the insulating switching shaft 3. The respective opening distances between the contact points 15 and 17 of the first breaking portion 20, and between the contact points 25 and 27 of the second breaking portion 30, guarantee that the contacts remain open, thereby completing the breaking operation.

A manual switching operation can be performed by swinging the operation handle 33, simultaneously switching the first and second movable contacts 12 and 21 respectively with each other in response to the switching operation of the switching mechanism 40.

As has been described above, the first breaking portion 20 is arranged to be tripped by the overcurrent tripping device 31 through the switching mechanism 40 and the second breaking portion 30. These are connected in series to the first breaking portion 20 and arranged to be opened by an electromagnetic repulsion force. Further, they are constructed so that the respective movable contacts 12 and 21 of the first and second breaking portions 20 and 30 respectively are supported so as to be kept at the opened positions by the common insulating switching shaft 3, interlocked with the switching operation of the switching mechanism 40. Thus, it is easy to make the circuit breaker small in size. Further, it is possible to obtain a high breaking capacity because re-closing of the second breaking portion 30 can be prevented from occurring in the final step of the breaking operation.

According to the present invention, in a circuit breaker, respective movable contacts of a first breaking portion tripped by an overcurrent tripping device through a switching mechanism and a second breaking portion connected in series with the first breaking portion and opened by an electromagnetic repulsion force, are supported so as to be kept at the open positions by a common insulating switching shaft interlocked with the switching operation of the switching mechanism. The circuit breaker is small in size and has a high breaking capacity.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the applicant's general inventive concept.

What is claimed is:

1. A circuit breaker assembly comprising:

a housing means for enclosing the circuit breaker assembly, including a substantially rectangular casing with an outer face;

a first breaking means for breaking the current, mounted within the casing;

a second breaking means for breaking the current, mounted within the casing, adjacent said first breaking means, and connected in series with said first breaking means;

a switching means for manually tripping said first and second breaking means;

an overcurrent tripping device operable to trip said first breaking means in an overcurrent condition; and an insulating switching shaft mounted in the casing, disposed to support both the first and second breaking means.

2. The circuit breaker of claim 1, wherein said first breaking means includes a first fixed contact mounted to a first side wall of the casing and a first moveable contact in opposed relation to the first fixed contact rotatably mounted to the insulating switching shaft with a first pivot pin at a point midway along the length of said switching shaft, first spring means mounted between the first moveable contact in the insulating switching shaft for urging said first moveable contact toward said first fixed contact, and a first arc-extinguishing means partially enclosing said first moveable and first fixed contacts for preventing an arc during breaker operation.

3. The circuit breaker of claim 2, wherein said second breaking means includes a second fixed contact mounted to a second side wall of the casing, and a second moveable contact in opposed relation to the second fixed contact, rotatably mounted to the insulating switching shaft with a second pivot pin at a point adjacent the first moveable contact, second spring means mounted between the second moveable contact and the insulating switching shaft for urging said second moveable contact toward said second fixed contact, and a second arc extinguishing means partially enclosing the second moveable and second fixed contacts for preventing an arc during breaker operations.

4. The circuit breaker of claim 3, wherein said second moveable contact is series-connected with said first moveable contact through a flexible conductor extended between said first and second pivot pins.

5. The circuit breaker of claim 1, wherein said housing means includes an aperture and said switching means includes an operating handle penetrating said aperture, fixedly connected in the casing to a switching lever which is rotatably supported by the walls of said casing, a pliable toggle link connecting said switching lever to said insulating switching shaft, switching spring means for connecting said toggle link to said switching lever, and a tripping link adjacent said toggle link at one end and in abutting relationship to said overcurrent tripping device at another end.

6. The circuit breaker of claim 5, wherein said tripping link deforms said pliable toggle link during an overcurrent condition in the overcurrent tripping device.

7. The circuit breaker of claim 5, wherein said switching lever in combination with said switching spring means deforms said pliable toggle link during manual operation.

8. The circuit breaker of claim 1, wherein said deformed toggle link is operable to move the insulating switching shaft against the urging of said first and second spring means in both an overcurrent condition or manual operation.

* * * * *